US009677217B2

(12) United States Patent
Kim et al.

(10) Patent No.: US 9,677,217 B2
(45) Date of Patent: Jun. 13, 2017

(54) METHOD FOR CONTROLLING LAUNDRY TREATING APPARATUS

(71) Applicant: LG Electronics Inc., Seoul (KR)

(72) Inventors: Jeongyun Kim, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 515 days.

(21) Appl. No.: 14/096,174

(22) Filed: Dec. 4, 2013

(65) Prior Publication Data

US 2014/0157621 A1 Jun. 12, 2014

(30) Foreign Application Priority Data

Dec. 7, 2012 (KR) ..... 10-2012-0141933

(51) Int. Cl.

| | |
|---|---|
| ***F26B 21/06*** | (2006.01) |
| ***F26B 3/00*** | (2006.01) |
| ***D06F 58/28*** | (2006.01) |
| ***F26B 21/00*** | (2006.01) |
| ***D06F 58/22*** | (2006.01) |

(52) U.S. Cl.

CPC ..... *D06F 58/28* (2013.01); *D06F 58/22* (2013.01); *F26B 21/003* (2013.01); *D06F 2058/2858* (2013.01); *D06F 2058/2887* (2013.01)

(58) Field of Classification Search

CPC ..... D06F 58/22; D06F 2058/2858
USPC ..... 34/82, 480
See application file for complete search history.

(56) References Cited

U.S. PATENT DOCUMENTS

| | | | | |
|---|---|---|---|---|
| 4,700,492 | A * | 10/1987 | Werner | D06F 58/22 34/403 |
| 5,497,563 | A * | 3/1996 | Mayfield | D06F 58/22 34/572 |
| 7,891,113 | B2 | 2/2011 | Oh | |
| 2003/0154618 | A1* | 8/2003 | Treu | D06F 58/22 34/85 |
| 2007/0163056 | A1* | 7/2007 | Lee | D06F 58/28 8/149.2 |

(Continued)

FOREIGN PATENT DOCUMENTS

| | | |
|---|---|---|
| CN | 87208790 | 9/1988 |
| CN | 1261634 | 8/2000 |

(Continued)

OTHER PUBLICATIONS

Chinese Office Action dated Jul. 17, 2015 for Chinese Appication No. 201310659428.2, with English Translation, 21 Pages.

(Continued)

*Primary Examiner* — Kenneth Rinehart
*Assistant Examiner* — John McCormack
(74) *Attorney, Agent, or Firm* — Fish & Richardson P.C.

(57) ABSTRACT

The present invention relates to a method for controlling a laundry treating apparatus including a drum for holding laundry, a connection duct for exhausting air from an inside of the drum, an exhaust duct provided parallel to a length direction of the drum connected to the connection duct, a filter assembly with a filter unit provided to the exhaust duct for filtering the air and a brush for removing foreign matter from the filter unit, a brush drive unit for making the brush to reciprocate a section of the filter unit, and a position sensing unit for sensing a position of the brush.

16 Claims, 9 Drawing Sheets

(56) References Cited

U.S. PATENT DOCUMENTS

| | | | | |
|---|---|---|---|---|
| 2007/0186438 | A1* | 8/2007 | Woerdehoff | D06F 58/28 34/486 |
| 2008/0098615 | A1* | 5/2008 | Kim | D06F 58/28 34/493 |
| 2008/0313923 | A1 | 12/2008 | Oh | |
| 2011/0225837 | A1* | 9/2011 | Ahn | D06F 58/04 34/82 |
| 2011/0271543 | A1 | 11/2011 | Kim et al. | |
| 2013/0145638 | A1 | 6/2013 | Kim | |
| 2013/0145645 | A1 | 6/2013 | Kim | |
| 2013/0145648 | A1 | 6/2013 | Kim | |

FOREIGN PATENT DOCUMENTS

| | | | | |
|---|---|---|---|---|
| CN | 2885911 | | 4/2007 | |
| CN | 101289799 | A | 10/2008 | |
| CN | 202298256 | | 7/2012 | |
| CN | 202380300 | | 8/2012 | |
| CN | 202380305 | | 8/2012 | |
| DE | 10-2006060031 | A1 | 6/2008 | |
| DE | WO 2008074581 | A1 * | 6/2008 | D06F 58/22 |
| WO | WO 2008/074581 | A1 | 6/2008 | |
| WO | WO 2013/085354 | A1 | 6/2013 | |

OTHER PUBLICATIONS

United Kingdom Office Action dated May 1, 2014 for Application No. GB1321617.1, in English, 6 Pages.

Chinese Office Action dated Feb. 6, 2016 for Chinese Application No. 201310659428.2, with English translation, 24 pages.

Search Report issued in French Application No. 1362180 on May 13, 2016, 11 pages (with English translation).

* cited by examiner

METHOD FOR CONTROLLING LAUNDRY TREATING APPARATUS

CROSS REFERENCE TO RELATED APPLICATION

This application claims the benefit of Korean Patent Application No. 10-2012-0141933, filed on Dec. 7, 2012, which is hereby incorporated by reference as if fully set forth herein.

BACKGROUND OF THE DISCLOSURE

Field of the Disclosure

The present invention relates to a method for controlling a laundry treating apparatus having a filter assembly provided thereto.

Discussion of the Related Art

The laundry treating apparatus is a general term of a domestic appliance including a washing machine, a dryer for drying clothes, and a washing and drying machine for washing and drying clothes.

In the meantime, in the laundry treating apparatuses which can dry clothes (A drying object), there are an exhaust type laundry treating apparatus and a circulating type laundry treating apparatus.

That is, in the laundry treating apparatuses which can dry clothes, there are an exhaust type laundry treating apparatus which exhausts humid high temperature air from a drum to an outside of the laundry treating apparatus, and a circulating type laundry treating apparatus in which a heat exchanger condenses and heats the air discharged from the drum while the humid high temperature air from the drum is re-supplied to the drum (While the air from the drum is circulated).

In the meantime, the air exhausting from the drum during drying may contain foreign matter (Lint and so on) from the drying object, such as the clothes. If such foreign matter is accumulated on elements in the laundry treating apparatus, something wrong may take place in the laundry treating apparatus, and, if the foreign matter flies out to an outside of the laundry treating apparatus, the foreign matter is liable to pollute air of a room having the laundry treating apparatus installed therein.

Therefore, the laundry treating apparatus having a drying function provided thereto is required to have the foreign matter removed from the air exhausting from the drum.

A related art laundry treating apparatus having a drying function provided thereto has a connection duct provided along a height direction of the drum and an exhaust duct provided along a length direction of the drum, wherein the connection duct has a filter provided thereto for filtering the air exhausting from the drum.

However, in general, since a size of the laundry treating apparatus is set by standards of each country, extension of a length of the connection duct (Length of the connection duct provided along the height direction of the drum) is not easy, accordingly. As far as the extension of the length of the connection duct is not easy, the related art laundry treating apparatus has a problem in that enlarging a filtering capacity of the filter provided to the connection duct has not been easy.

And, the related art laundry treating apparatus is not convenient in that dropping of drying efficiency of the laundry treating apparatus can be prevented only if a user cleans the filter after an amount of the foreign matter accumulated at the filter is determined every time the user uses the laundry treating apparatus.

And, since the related art laundry treating apparatus has a problem in that the user can not determine whether the filter is mounted to the laundry treating apparatus or not, there has been a risk in that the user is liable to put the laundry treating apparatus into operation even if the filter is not mounted to the laundry treating apparatus.

And, since the related art laundry treating apparatus has a problem in that an amount of the foreign matter remained in the filter can not be determined, there is a problem in that the related art laundry treating apparatus can not notify the user of a filter cleaning time.

And, the related art laundry treating apparatus has a problem in that it can not be determined whether the drop of the dry efficiency is caused by the filter blocked by the foreign matter or the duct blocked by the foreign matter.

SUMMARY OF THE DISCLOSURE

To solve the problems, an object of the present invention is to provide a laundry treating apparatus which enables enlargement of a filtering capacity of a filter; and a method for controlling the same.

Another object of the present invention is to provide a laundry treating apparatus which enables to provide a structure which can, not only increase a flow rate of heated air to be supplied to a drum which holds laundry, but also enlarge filtering capacity, thereby making the laundry treating apparatus to be useful as a commercial dryer; and a method for controlling the same.

Another object of the present invention is to provide a laundry treating apparatus which enables periodic cleaning of foreign matter accumulated on a filter; and a method for controlling the same.

Another object of the present invention is to provide a laundry treating apparatus which enables to prevent drying efficiency from dropping during a drying step is in progress by periodic cleaning of a filter by supplying air during the drying step is in progress; and a method for controlling the same.

Another object of the present invention is to provide a laundry treating apparatus which enables to determine whether a filter is mounted to the laundry treating apparatus or not; and a method for controlling the same.

Another object of the present invention is to provide a laundry treating apparatus which notifies a user of a filter cleaning time according to an amount of foreign matter remained at a filter; and a method for controlling the same.

Another object of the present invention is to provide a laundry treating apparatus which enables to determine whether drop of the dry efficiency is caused by a filter blocked by foreign matter or a duct blocked by foreign matter; and a method for controlling the same.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a laundry treating apparatus having a drum for holding laundry, a connection duct for exhausting air from an inside of the drum, an exhaust duct provided parallel to a length direction of the drum connected to the connection duct, a filter assembly with a filter unit provided to the exhaust duct for filtering the air and a brush for removing foreign matter from the filter unit, a brush drive unit for making the brush to reciprocate a section of the filter unit, and a position sensing unit for sensing a position of the brush, the method includes a step for supplying power to the laundry treating apparatus, a mount sensing step for, after operating the brush drive unit temporarily, determining whether the position sensing means senses a position of the brush or not to determine whether the filter assembly is mounted to the duct or not, and a step for cutting off power supply to the laundry treating apparatus if the position sensing unit fails to sense the position of the brush.

The position sensing unit may include magnetic force forming means provided to the brush, and two magnetic force sensing means for sensing whether the magnetic force forming means is reached to a limiting point of reciprocating movement of the brush, and the step for cutting off power supply to the laundry treating apparatus may be progressed if at least one of the two magnetic force sensing means fails to sense the magnetic force forming means in the mount sensing step.

The method may further include a filter checking request step for displaying a warning message or emitting a warning signal with a display unit or a speaker provided to the laundry treating apparatus before cutting off power supply to the laundry treating apparatus, if at least one of the two magnetic force sensing means fails to sense the magnetic force forming means in the mount sensing step.

The warning message may be a letter for requesting a user to remove the foreign matter from the filter assembly, or to check whether the filter assembly is mounted or not, and the warning signal may be a sound signal for requesting the user to remove the foreign matter from the filter assembly, or to check whether the filter assembly is mounted or not.

If one of the two magnetic force sensing means fails to sense the magnetic force forming means in the mount sensing step, the filter checking request step may include a step for requesting removal of the foreign matter from an inside of the filter assembly with the display unit or the speaker.

If both of the two magnetic force sensing means fail to sense the magnetic force forming means in the mount sensing step, the filter checking request step may include a step for requesting to check whether the filter assembly is mounted or not with the display unit or the speaker.

The method may further include an air supply step for putting an air supply unit into operation to supply heated or unheated air to the drum, if both of the two magnetic force sensing means sense the magnetic force forming means in the mount sensing step.

The method may further include a filter cleaning step for controlling the brush drive unit to make the brush to remove the foreign matter from the filter unit during the air supply step is in progress, periodically.

The air supply step may include the step of supplying heated air to the drum with a fan which supplies air to the drum, and heating means which is put into operation below a predetermined temperature and discontinues operation if a predetermined temperature is exceeded.

A filter cleaning step may be progressed for controlling the brush drive unit to make the brush to remove the foreign matter from the filter unit if an operation time period of the heating means is longer than a reference time period during the air supply step is in progress, and a blocking classifying step may be progressed for determining whether the filter unit is blocked by the foreign matter or the connection duct is blocked by the foreign matter if the operation time period of the heating means is shorter than a reference time period during the air supply step is in progress.

The blocking classifying step may include a step for, after controlling the brush drive unit to reciprocate the brush for a predetermined time period, if both of the two magnetic force sensing means sense the magnetic force forming means, notifying the user of blocking of the connection duct or the exhaust duct with the display unit or the speaker provided to the laundry treating apparatus.

The blocking classifying step may include a step for requesting the user to remove the foreign matter from the filter assembly with the display unit or the speaker, if at least one of the two magnetic force sensing means fails to sense the magnetic force forming means.

The method may further include a brush final drive step for controlling the brush drive unit after the air supply step is finished to make the brush to remove the foreign matter from the filter unit for a predetermined time period, a final notifying step for requesting the user to remove the foreign matter from the filter assembly with a display unit or a speaker provided to the laundry treating apparatus if at least one of the two magnetic force sensing means fails to sense the magnetic force forming means during the brush final drive step is in progress, and a step for finishing operation of the laundry treating apparatus after finishing the final notifying step.

The method may further include a cooling step for putting the fan into operation in a state operation of the heating means is discontinued if dryness of a drying object held in the drum is reached to a predetermined dryness or a progress time period of the air supply step is reached to a predetermined time period during the air supply step is in progress.

The method may further include a brush final drive step for controlling the brush drive unit to make the brush to remove the foreign matter from the filter unit for a predetermined time period during the cooling step is in progress or after the cooling step is finished, a final notifying step for requesting the user to check the filter assembly with a display unit or a speaker provided to the laundry treating apparatus if at least one of the two magnetic force sensing means fails to sense the magnetic force forming means during the brush final drive step is in progress, and a step for finishing operation of the laundry treating apparatus after finishing the final notifying step.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

In the meantime, a configuration of an apparatus or a method for controlling an apparatus to be described hereinafter is only for describing preferred embodiment of the present invention, but not for limiting scopes of patent rights of the present invention.

Figure 1:
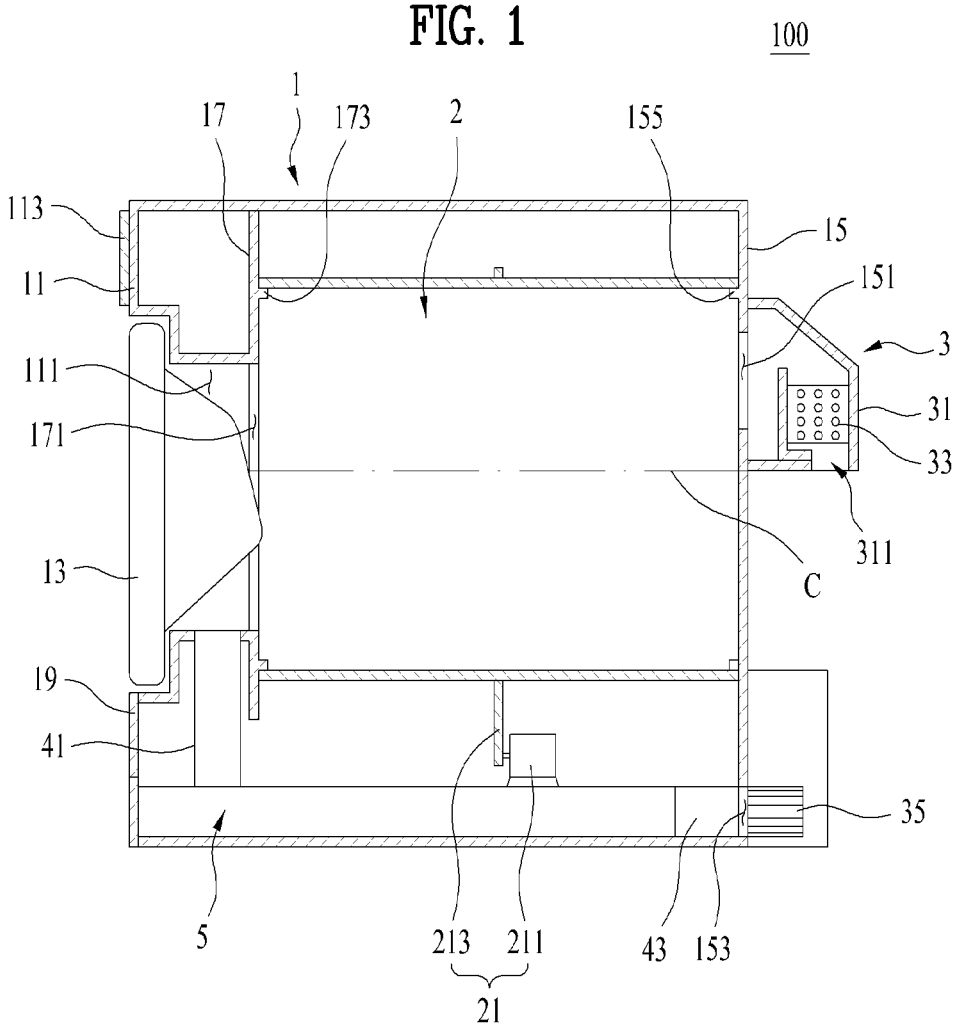
FIG. 1 illustrates a section of a laundry treating apparatus in accordance with a preferred embodiment of the present invention.

Referring to FIG. 1, a laundry treating apparatus 100 in accordance with another preferred embodiment of the present invention includes a cabinet 1 which forms an exterior appearance of the laundry treating apparatus 100, a drum 2 rotatably mounted in the cabinet 1 for holding laundry, an air supply unit 3 for supplying heated air or unheated air to the drum, an exhaust flow passage 4 for exhausting air from the drum to an outside of the drum, and a filter assembly 5 for removing foreign matter from the air exhausting from the drum.

The cabinet 1 includes a front panel 11 having an introduction opening 111 provided therein, and a rear panel 15 having an air introduction opening 151 provided therein to be in communication with an inside of the drum 2.

A user may introduce laundry to the drum 2 through the introduction opening 111 or take the laundry out of the drum 2 through the introduction opening 111. The introduction opening 111 is opened/closed by a door 13 rotatably secured to the front panel 11.

The front panel 11 may have a control panel 113 further provided thereto having an input unit (Not shown) for inputting a control order to the laundry treating apparatus, and a display unit (Not shown) for displaying control contents of the laundry treating apparatus.

The rear panel 15 is provided opposite to the front panel to face the front panel, and the air introduction opening 151 is provided to pass through the rear panel 15 for introducing the air from the air supply unit 3 to the drum 2.

Figure 2:
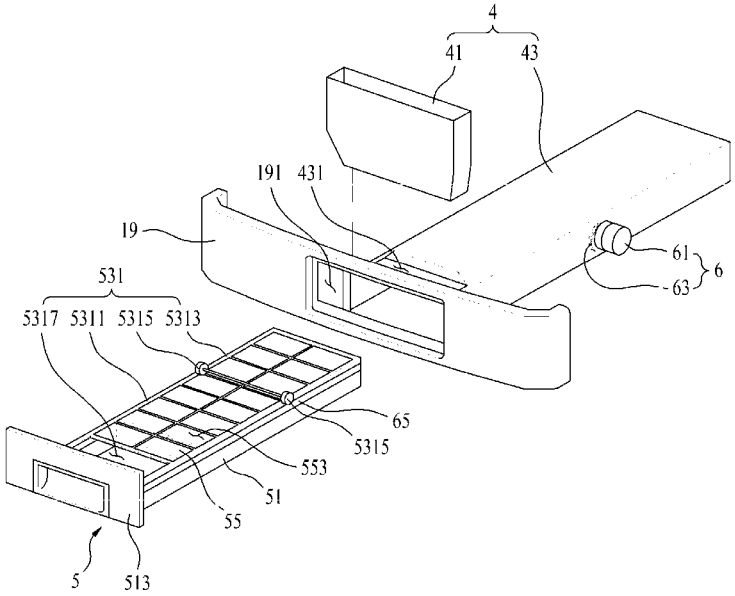
FIG. 2 illustrates a perspective view of an exhaust flow passage and a filter assembly provided to a laundry treating apparatus in accordance with a preferred embodiment of the present invention.

In the meantime, the rear panel 15 may have an air exhaust hole 153 for making the air from the drum 2 to move to an outside of the cabinet 1 through the exhaust flow passage 4 (See FIG. 2).

Moreover, the rear panel 15 may have a rear flange 155 provided thereto further for rotatably supporting a rear side of the drum 2, which will be described in detail, later.

The cabinet 1 may have a drum supporting portion 17 provided therein for rotatably supporting a front side of the drum 2. The drum supporting portion 17 includes a supporting portion pass through hole 171 which makes the introduction opening 111 and the inside of the drum 2 in communication with each other.

Therefore, the laundry introduced to the inside of the cabinet 1 through the introduction opening 111 may move to the drum 2 through the supporting portion pass through hole 171.

Moreover, the drum supporting portion 17 may further include a front flange 173 for rotatably supporting a front side of the drum 2, wherein the front flange 173 is provided along an outside circumference of the supporting portion pass through hole 171.

In this case, the front flange 173 may have a diameter larger than a diameter of the supporting portion pass through hole 171 according to a diameter of the drum 2.

The drum 2 may have a cylindrical shape with opened front and rear sides, and, as described before, the drum 2 has the front side rotatably supported by the front flange 173, and the rear side rotatably supported by the rear flange 155.

And, the drum 2 is rotated by the drum drive unit 21 which includes a motor 211, and a belt 213 which connects a rotation shaft of the motor to an outside circumference of the drum 2.

The air supply unit 3 is means for supplying heated air or unheated air to the drum 2 to induce heat exchange between the laundry and the air and may include a heater housing 31 provided to the rear panel 15, a heater (Heating means) 33 provided to an inside of the heater housing, and a fan 35 provided to the exhaust flow passage 4 (Provided to the connection duct 41 or the exhaust duct 43).

The heater housing 31, provided to surround the air introduction opening 151 in the rear panel, and may further include a housing introduction opening 311 for introduction of air to an inside of the heater housing 31.

Thus, the heater housing 31 is provided, not to the inside, but to the outside of the cabinet 1 for drying a large amount of laundry.

As the amount of the laundry becomes the larger, the larger flow rate of air supply to the inside of the drum 2 is required for drying the laundry within a predetermined time period. Accordingly, the laundry treating apparatus for drying a large amount laundry essentially requires a large capacity heater (Heating means) for increasing the flow rate of the air to be supplied to the drum as well as heating a high flow rate of the air.

However, if the large capacity heater is provided to the inside of the cabinet 1 to increase, not only an outside shape of the cabinet 1, but also a temperature of the inside of the cabinet 1 due to the large capacity heater, there is a risk of damage to components in the laundry treating apparatus.

In order to solve such a problem, the laundry treating apparatus 100 of the present invention has the air supply unit 3 fixedly secured to an outside of the cabinet 1, owing to which the laundry treating apparatus of the present invention may be utilized as a commercial laundry treating apparatus which requires fast and large quantity laundry drying.

As described before, the exhaust flow passage 4, means for exhausting the air from the inside of the drum 2 to the outside of the cabinet 1, may include a connection duct 41 provided along a height direction of the drum 2, and an exhaust duct 43 provided along a length direction of the drum 2 for exhausting the air from the connection duct 41 to the outside of the cabinet 1.

The connection duct 41 is means positioned under (In front of the supporting portion pass through hole 171) the introduction opening 111 for making the air to move from the inside of the drum 2 to the exhaust duct 43. That is, the connection duct 41 connects an outside circumferential surface of the introduction opening 111 to a duct connection hole 431 (See FIG. 2) of the exhaust duct 43.

In the meantime, by connecting the connection duct 41 to the air exhaust hole 153, the exhaust duct 43 may make the air to exhaust from the drum 2 to the outside of the cabinet 1 through the connection duct 41.

In this case, the fan 35 provided to the air supply unit 3 may be provided to be fixedly secured to an outside of the cabinet 1 to draw the air from an inside of the exhaust duct 43.

As described before, though it is essential to secure a large flow rate of air for drying the large amount of laundry, it is not easy to mount a large capacity fan in the cabinet 1 which has a limited size.

Therefore, as shown in FIG. 1, if the fan 35 is fixedly secured to the rear panel 15 to enable to exhaust the air from the inside of the drum 2 through the air exhaust hole 153, mounting of the large capacity fan is possible without a size change of the cabinet 1.

The filter assembly 5 provided to the laundry treating apparatus 100 of the present invention is characterized in that the filter assembly 5 is provided, not to the connection duct 41, but to the exhaust duct 43, for filtering air exhausting from the drum 2.

The related art laundry treating apparatus has a difficulty in enlarging a filter capacity of the filter which is provided to the connection duct 41 because a length of the connection duct 41 can not be changed as far as a size of the laundry treating apparatus is not changed.

However, since the laundry treating apparatus 100 of the present invention has the filter assembly 5 provided to the exhaust duct 43 which is provided in the length direction of the drum 2 (A direction parallel to a rotation shaft C of the drum), the laundry treating apparatus 100 of the present invention has an effect of increasing the filtering capacity of the filter assembly, significantly.

Accordingly, the laundry treating apparatus 100 of the present invention can be utilized as a commercial laundry treating apparatus which requires fast and large amount laundry dry.

In the meantime, it is preferable that the filter assembly 5 is detachably provided to the exhaust duct 43. For this, the front panel 11 may have a filter supporting panel 19 provided thereto.

The filter supporting panel 19 may be positioned on a lower side (Under the door 13) of the front panel 11 and may have a filter inserting hole 191 (See FIG. 2) for inserting the filter assembly 5 therein.

A structure of the filter assembly 5 will be described with reference to FIGS. 2 and 3.

The filter assembly 5 includes a housing 51 having a holding space 511 provided therein for holding the foreign matter therein. The housing 51 may have a handle 513 provided thereto additionally for easy drawing/inserting of the housing 51 from/to the exhaust duct 43 through a filter inserting hole 191 in the filter supporting panel 19.

The housing 51 may have a rectangular cube shape with an opened side facing the connection duct 41. In this case, a filter unit 53 (See FIG. 3) is provided to the opened side of the housing.

In the meantime, provided in the housing, there are a brush 57 for removing the foreign matter from the filter unit 53, and a compression unit 55 for compressing the foreign matter removed by the brush 57 within the holding space 511.

The filter unit 53 includes a frame 531 positioned at the opened side of the housing 51, and a filter 533 secured to the frame.

The frame 531 includes an air introduction hole 5317 in communication with the duct connection hole 431. Therefore, the air exhausted from the drum through the connection duct 41 is introduced to an inside of the housing 51 through the duct connection hole 431 and the air introduction hole 5317, and, therefrom, exhausted to the outside (Inside of the exhaust duct 43) of the housing 51 through the filter 533.

In the meantime, the frame 531 may include a first frame 5311 having the air introduction hole 5317 provided therein, and a second frame 5313 hinge coupled to the first frame 5311. This is for easy taking the foreign matter held in the holding space 511 out of in the housing 51, which will be described later in detail.

The frame 531 may have a pinion receiving portion 5315 for receiving a pinion 65, 67 to be described later. The pinion receiving portion 5315 may be provided at a joined portion (boundary) of the first frame 5311 and the second frame 5313.

The brush 57 is means provided to be able to reciprocate an inside of the housing 51 (An inside of the holding space 511) for separating the foreign matter from the filter 533, and the compression unit 55 is means provided to be able to reciprocate the inside of the housing 51 for compressing the foreign matter held in the holding space 511.

Figure 3:
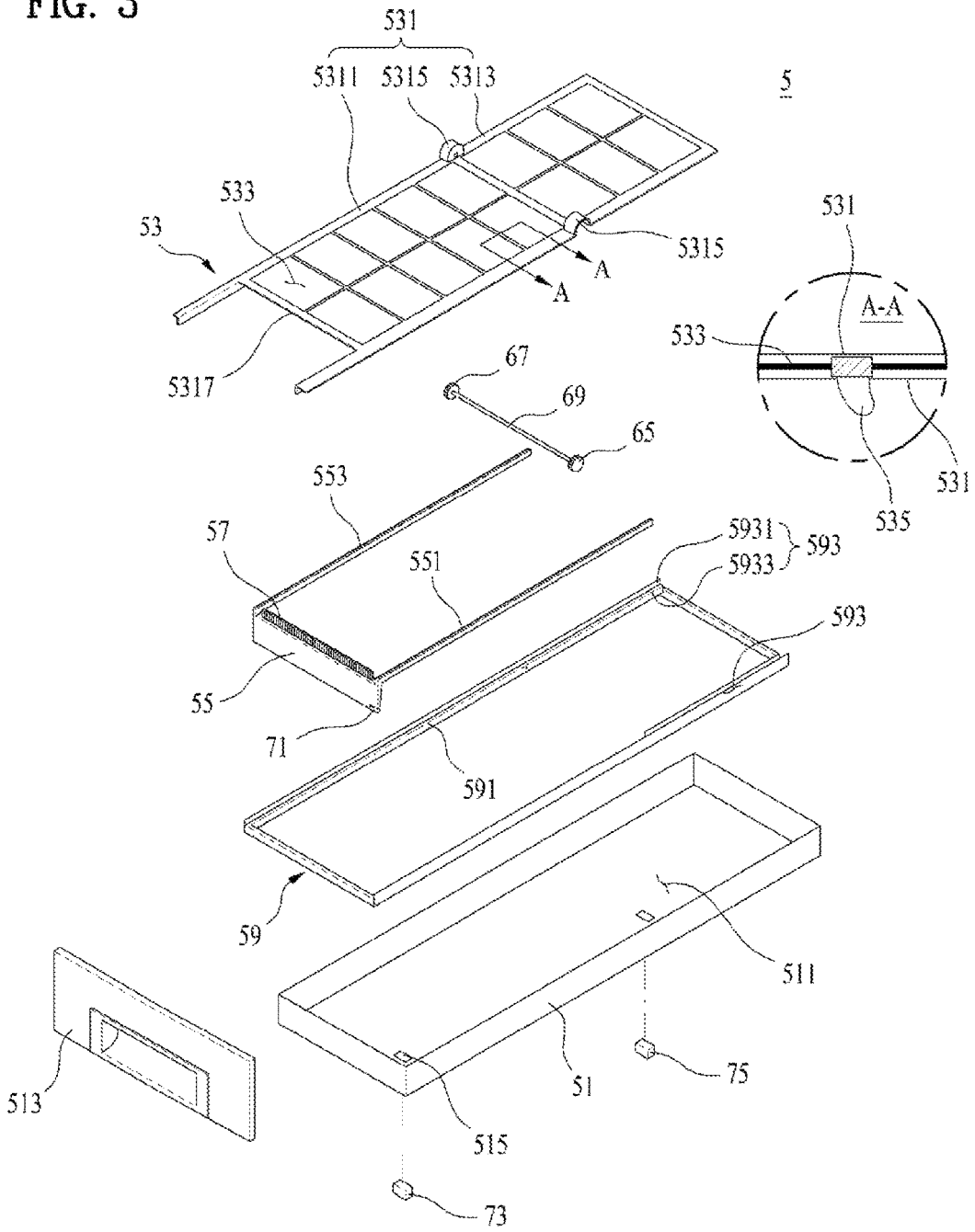
FIG. 3 illustrates an exploded perspective view of a filter assembly provided to a laundry treating apparatus in accordance with a preferred embodiment of the present invention.

Therefore, referring to FIG. 3, if the brush 57 is in contact with the filter 533 by providing the brush 57 to an upper side of the compression unit 55, an effect of operating the brush and the compression unit may be embodied only with one drive unit 6 (A brush drive unit) which makes the brush 57 to reciprocate in the holding space 511.

In the meantime, additionally provided to opposite ends of the compression unit 55 facing each other, there are a first rack 551 and a second rack 553 each having gears formed at a bar shaped body at fixed intervals. In this case, there may be a rack guider 59 provided to the opened side of the housing 51 for guiding movement of the racks 551 and 552, additionally.

That is, the rack guider 59 is provided between the frame 531 of the filter unit and the housing 51 for guiding movement of the first rack 551 and the second rack 553.

For this, the rack guider 59 may include a guider body 591 supported on the opened upper side of the housing 51, and a rack receiving portion 593 provided projected from the upper side of the guider body 591 for receiving the first rack and the second rack.

The rack receiving portion 593 may include a first guide flange 5913 provided to an outside length direction circumference of the guider body 591, and a second guide flange 5933 provided spaced from the first guide flange with a gap which can receive the first and second racks.

It is preferable that the second guide flange 5933 is provided, not to entire length direction of the guider body 591, but only to a portion of the guider body 593. This is for fixing a compression amount of the foreign matter of the filter assembly 5 by limiting movement of the compression unit 55 with the second guide flange 5933.

The foreign matter separated from the filter 533 by the brush 57 is moved by the compression unit 55 from a direction the air introduction hole 5317 is positioned up to a position the second guide flange 5933 is provided thereto.

Therefore, if the amount of the foreign matter held in the holding space 511 of the housing 51 becomes large, the compression unit 55 will compress the foreign matter to the holding space 511 movement thereto of the compression unit is limited by the second guide flange 5933.

In the meantime, in order to make the foreign matter separated from the filter 533 by the brush 57 can be separated from the brush 57 easily, a scraper 535 may be provided to the frame 531 of the filter unit 53, additionally.

The brush 57 may be provided as a plurality of projections projected from the upper side of the compression unit 55 spaced at predetermined distances. In this case, the scraper 535 may be a plurality of projections projected from the frame 531 spaced at the predetermined distances.

And, it is preferable that the scraper 535 is provided to be able to pass through a space formed between adjacent projections of the brush when the brush 57 reciprocates an inside of the holding space 511.

That is, it is preferable that the plurality of projections provided to the brush 57 are spaced from one another for preventing interference with the scraper 535.

This is, not only for preventing the brush 57 from being brought into contact with the scraper 535 to interfere with movement of the compression unit 55 when the compression unit 55 reciprocates the inside of the holding space, but also for the scraper to separate the foreign matter from between the projections of the brush, easily.

The compression unit 55 and the brush 57 reciprocate the inside of the holding space 511 by the brush drive unit 6.

The brush drive unit 6 may include a brush motor 61 fixedly secured to an outside of the exhaust duct 43, a motor gear 63 positioned in the exhaust duct 43, and a pinion 65, 67 provided to the pinion receiving portion 5315 engaged with the rack 551, 553.

Though the brush motor 61 may be provided to an inside of the exhaust duct 43, it will be favorable that the brush motor 61 is mounted to the outside of the exhaust duct 43 as shown in FIG. 2 for easy repair and maintenance of the filter assembly 5.

In the meantime, if the brush motor 61 is fixedly secured to the outside of the exhaust duct 43, the motor gear 63 will be coupled to the rotation shaft of the brush motor which is passed through the exhaust duct 43.

The pinion may include a first pinion 65 and a second pinion 67 provided to the pinion receiving portion in the frame 531. It is preferable that the first pinion and the second pinion are coupled to a connection shaft 69.

This is because, if there is a large amount of the foreign matter in the holding space 511 or at the filter 533, causing the compression unit 55 or the brush 57 to meet high resistance at the time of the reciprocating movement, it may be difficult to compress the foreign matter removed from the filter into an inside of the holding space if only one pinion is provided.

That is, since the brush drive unit of the present invention has the first pinion 65 and the second pinion 67 coupled with the connection shaft 69, and the first pinion 65 is engaged with the first rack 551 and the second pinion 67 is engaged with the second rack 553, if any one of the first pinion 65 and the second pinion 67 is connected to the motor gear 63, the brush drive unit can forward power to the brush and the compression unit, stably.

Figure 4:
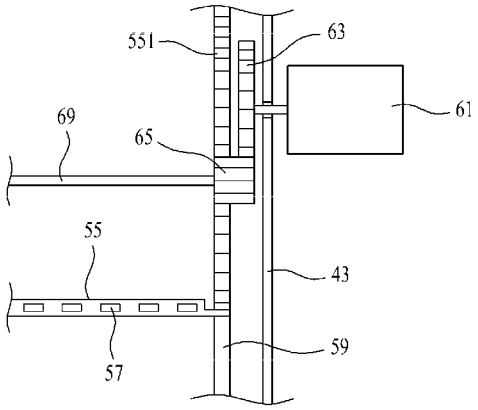
FIG. 4 illustrates a schematic view of a brush drive unit provided to a laundry treating apparatus in accordance with a preferred embodiment of the present invention.

In the meantime, referring to FIGS. 2 and 4, it is preferable that a distance from the filter inserting hole 191 to the pinion 65, 67 is shorter than a distance from the filter inserting hole 191 to the motor gear 63.

This is for making one of the pinions 65 and 67 to be separated from the motor gear 63 if the filter assembly 5 is taken out of the exhaust duct 43, and one of the pinions 65 and 67 to be coupled to the motor gear 63 if the filter assembly 5 is inserted in the exhaust duct 43.

Moreover, the connection shaft 69 may also function as a hinge shaft which rotatably connects the first frame 5311 and the second frame 5313 of the filter unit 53. In this case, the user may remove the foreign matter from the inside of the housing 51 by opening the second frame 5313, which enables easier removal of the foreign matter from the housing 51 than a case the first frame 5311 and the second frame 5313 of the filter unit 53 are provided as one unit.

The laundry treating apparatus 100 of the present invention may further include a holding amount sensing unit which determines an amount of the foreign matter in the holding space 511.

The holding amount sensing unit may have any mode as far as it can sense the amount of foreign matter in the holding space 511.

Figure 5:
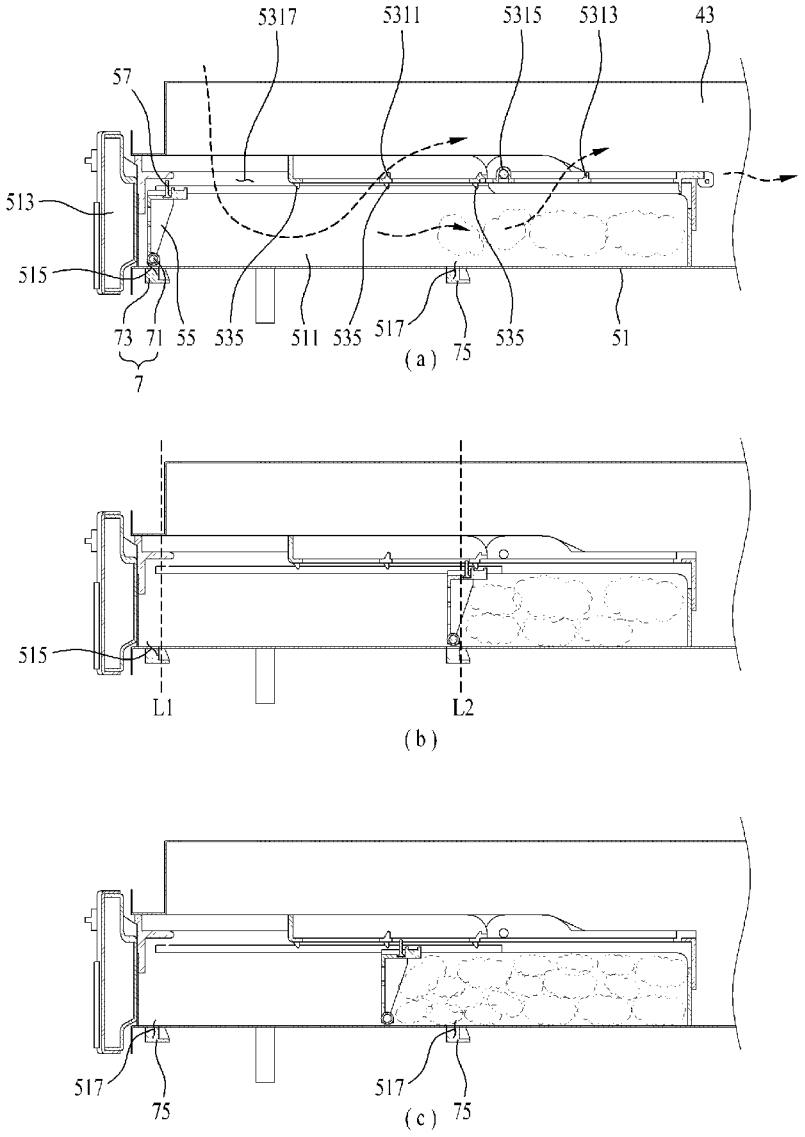
FIGS. 5A, 5B, and 5C illustrate sections showing operation steps of a filter assembly provided to a laundry treating apparatus in accordance with a preferred embodiment of the present invention.

However, since FIG. 5 illustrates an example of the holding amount sensing unit which determines the amount of the foreign matter in the holding space 511 by sensing a position of the compression unit 55 or the brush 57 when the brush drive unit 6 is in operation, the holding amount sensing unit will be called as a position sensing unit 7, hereafter.

The position sensing unit 7 of the present invention may include magnetic force forming means 71 provided to the compression unit 55 or the brush 57, and at least two magnetic force sensing means 73 and 75 each for sensing a position of the magnetic force forming means.

Referring to FIG. 5, if the magnetic force forming means 71 is provided to the compression unit 55, the magnetic force sensing means 73 and 75 may be fixedly secured to the inside of the exhaust duct 43 so that the magnetic force sensing means 73 and 75 sense the magnetic force forming means 71 through holes 515 and 517 formed in a bottom of the holding space 511.

In the meantime, the magnetic force forming means 71 may be provided in a mode of a permanent magnet or an electro-magnet and the magnetic force sensing means 73 and 75 may be a reed switch which generates an ON-OFF signal in response to a magnetic force the magnetic force forming means provides thereto and transmits the signal to a controller (Not shown).

And, the magnetic force sensing means may be provided as first magnetic force sensing means 73 for sensing whether the compression unit 55 is positioned at an initial position (A first limiting point L1 of the reciprocating movement of the compression unit) or not, and second magnetic force sensing means 75 for determining whether a held amount of the foreign matter exceeds a predetermined holding amount or not.

The initial position may be set to any position of the housing 51 as far as the position does not interfere with a flow of the air being introduced to the inside of the filter assembly 5 through the air introduction hole 5317, wherein FIG. 5 illustrates a case in which a front side of the housing 51 (A side of the housing where the handle 513 is positioned, or a space between the air introduction hole 5317 and the handle 513) is set as the initial position.

In the meantime, once the filter assembly 5 is inserted in the exhaust duct 43, the first magnetic force sensing means 73 and the magnetic force forming means 71 will become to face each other through the first hole 515 in the bottom of the housing 51.

The second magnetic force sensing means 75 is provided at a position which enables to determine whether the amount of the foreign matter held in the housing 51 is reached to an amount the filter assembly 5 can hold or not.

A largest amount of the foreign matter the housing 51 can hold may be set as an amount of the foreign matter which drops the dry efficiency, seriously.

If movement of the compression unit 55 and the brush 57 is limited by the second guide flange 5933, the largest amount of the foreign matter the housing 51 can hold will be an amount of the foreign matter which can be held in a space of the housing 51 positioned below the second guide flange 5933.

In this case, it is preferable that the second magnetic force sensing means 75 is positioned at a second limiting point L2 of the reciprocating movement of the compression unit 55. That is, the second magnetic force sensing means 75 may be provided at a position the same with a front edge of the second guide flange 5933 facing the air introduction hole 5317.

Accordingly, by determining whether the first magnetic force sensing means 73 senses the magnetic force forming means 71 or not before putting the laundry treating apparatus 100 into operation, the controller (Not shown) can determine whether the brush 57 and the compression unit 55 are at the initial position or not, and whether the filter assembly 5 is mounted to the exhaust duct 43 or not.

And, by determining whether the second magnetic force sensing means 75 senses the magnetic force forming means 71 or not, the controller can determine a time point for removing the foreign matter from the filter assembly 5.

If the foreign matter held in the housing 51 is small, though the second magnetic force sensing means 75 can sense the magnetic force forming means 71 as shown in FIG. 5B, if the foreign matter held in the housing 51 is large, the second magnetic force sensing means 75 can sense the magnetic force forming means 71 with difficulty as shown in FIG. 5C.

Therefore, in the present invention, if the second magnetic force sensing means 75 fails to sense the magnetic force forming means 71, the controller (Not shown) may request the user for removal of the foreign matter from the filter assembly 5 with notifying means {A display unit (Not shown) or a speaker (not shown)}.

Figure 6:
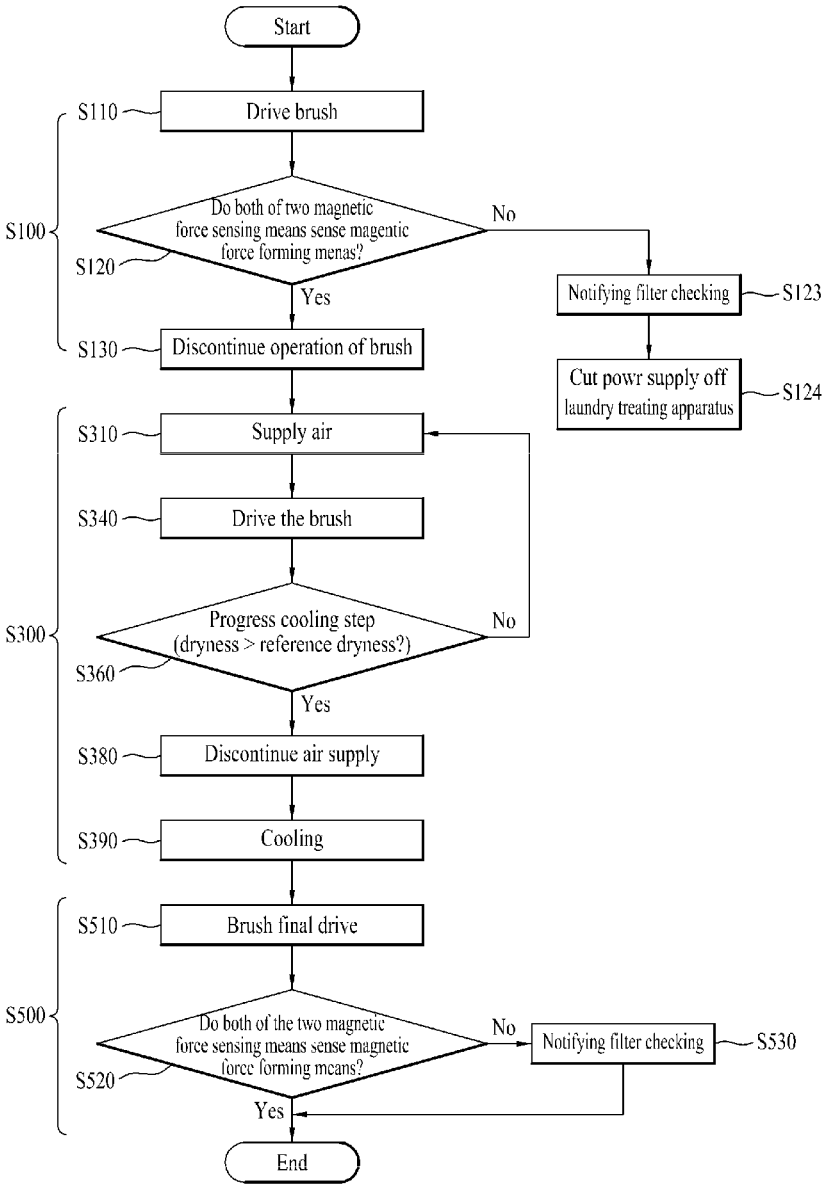
FIG. 6 illustrates a flow chart showing the steps of a method for controlling a laundry treating apparatus in accordance with a preferred embodiment of the present invention.

FIG. 6 illustrates a flow chart showing the steps of a method for controlling a laundry treating apparatus in accordance with a preferred embodiment of the present invention, referring to which a method for controlling a laundry treating apparatus in accordance with a preferred embodiment of the present invention will be described.

The method for controlling a laundry treating apparatus of the present invention starts with power supply to the laundry treating apparatus 100, and may include a mount sensing step S100 for determining whether a filter assembly 4 is mounted to the laundry treating apparatus or not, a drying step S300 for supplying air to a drum to dry laundry, and a final drive step (A filter cleaning step after drying) 5500 for cleaning a filter unit 53 for a predetermined time period before finishing operation of the laundry treating apparatus (After air supply to the drum is finished).

The mount sensing step S100 is a step for determining whether the filter assembly 5 is mounted or not and whether removal of foreign matter from the filter assembly 5 is required or not by determining whether a magnetic force sensing means 73, 75 positioned at limiting points L1 and L2 of a reciprocating movement of a brush 71 senses magnetic force forming means 71 or not.

Since the drying step S300 starts with running an air supply step S310 in which unheated or heated air is supplied to the drum 2, it is preferable that the mount sensing step S100 is run before the air supply step S310.

For this, the mount sensing step S100 includes a brush drive step S110, S130 for driving the brush drive unit 6 for a predetermined time period, and a brush sensing step S120 for sensing a position of magnetic force forming means 71 with magnetic force sensing means 73, 75 during the brush drive step is in progress.

The brush drive step S110 is a step for a controller (Not shown) to control the brush drive unit 6 to make the compression unit 55 and the brush 57 to reciprocate between the limiting points L1 and L2 of reciprocating movement for a predetermined time period S130.

In the meantime, the brush sensing step S120 is a step for determining whether both of the magnetic force sensing means 73 and 75 respectively positioned at the limiting points L1 and L2 of the reciprocate movement sense the magnetic force forming means 71 or not.

If both of the magnetic force sensing means 73 and 75 sense the magnetic force forming means 71 fixedly secured to the compression unit 55 (If both of the magnetic force sensing means 73 and 75 sense a position of the brush 57), determining that the filter assembly 5 is mounted to the exhaust duct 43, and a small amount of foreign matter is present in the housing 51 of the filter assembly, the controller (Not shown) starts the drying step S310.

However, if both of the magnetic force sensing means 73 and 75 fail to sense the magnetic force forming means 71, the control method of the present invention progresses a prior drying notifying step S123, and S124 for notifying a user of a state of the filter assembly 5.

The prior drying notifying step S123, and S124 may also be progressed in a case only one of the two magnetic force sensing means 73, and 75 senses the magnetic force forming means 71.

That is, the prior drying notifying step S123, and S124 may also be progressed in a case at least one of the two magnetic force sensing means 73, and 75 fails to sense the magnetic force forming means 71.

The prior drying notifying step may be provided with a filter checking request step S123 for notifying the user of a state in which the filter assembly 5 is not mounted to the duct, or the filter assembly 5 has a full-load of the foreign matter with a display unit (Not shown, displaying a warning message) or a speaker (Not shown, emitting a warning signal), and a step S124 for cutting off power supply to the laundry treating apparatus after the filter checking request step.

As described before, the laundry treating apparatus of the present invention may be used commercially. In the method for controlling a laundry treating apparatus of the present invention, the cutting off power supply to the laundry treating apparatus is made after the filter checking request step S123, taking a point into account, that the laundry treating apparatus comes into operation only if the user pays an amount of money in the case the commercial laundry treating apparatus.

If the laundry treating apparatus of the present invention is used commercially, the laundry treating apparatus 100 may have an operation time period determined according to an amount of money the user pays. Therefore, if the filter assembly 5 is not mounted to the laundry treating apparatus 100, or cleaning of the foreign matter from the inside of the filter assembly 5 is required, a problem in which clean laundry drying can not be made, a problem in which stable operation of the laundry treating apparatus can not be made, and a problem in which the drying efficiency becomes poor, may be caused.

Failure of making the clean laundry drying, or the poor drying efficiency may cause an additional expense to the user, and failure of making the stable operation of the laundry treating apparatus causes an expense required for maintenance and repair to a manager of the commercial laundry treating apparatus. Since the power supply to the laundry treating apparatus is cut off if the magnetic force sensing means 73, 75 fails to sense the magnetic force forming means 71 in the brush sensing step S120, the control method of the present invention can prevent above problems from taking place.

That is, if the laundry treating apparatus of the present invention is used as a commercial laundry treating apparatus, it may be provided that the power supply step and the mount sensing step S100 are run before the user pays a predetermined amount of money, and the drying step S300 is run after the user pays the predetermined amount of money.

In this case, since the controller determines whether the filter assembly 5 is mounted or not and whether the amount of foreign matter loaded on the filter assembly 5 is large or not in the mount sensing step S100, and cuts off the power supply to the laundry treating apparatus 100 if the filter assembly 5 is not mounted, or the amount of foreign matter loaded on the filter assembly 5 is large, the control method of the present invention can prevent above problems from taking place, which are liable to take place in cases the filter assembly 5 is not mounted, or the amount of foreign matter loaded on the filter assembly 5 is large.

Moreover, by inducing the user to progress the filter checking request step S123 before the cutting off S124 of the power supply so that the user cleans the filer assembly 5 or mounts the filter assembly 5 to the exhaust duct 43, the control method of the present invention can prevent user's payment from increasing, or prevent the expense the user paid from losing.

For this, the control method of the present invention may further include a step (Not shown) for determining whether a predetermined amount of money is paid or not if both of the magnetic force sensing means sense the magnetic force forming means in the brush sensing step S120.

The step (Not shown) for determining whether a predetermined money is paid or not will be progressed after stopping drive of the brush S130, and if the predetermined amount of money is paid, the drying step S300 will start.

In the meantime, if the filter assembly 5 being not in out of order is sensed in the mount sensing step S100, the control method of the present invention progresses the drying step S300.

The drying step S300 starts with starting of an air supply step S310, wherein the air supply step S310 is a step for supplying heated or unheated air to the inside of the drum 2.

If the heated air is supplied to the inside of the drum 2, the air supply step S310 will be progressed by operating a heater (Heating means) 33 and a fan 35.

In the meantime, the drying step S300 includes a brush driving step S340 for repeating driving and stopping of the brush 57 and the compression unit 55 at fixed intervals during the air supply step S310 is in progress. This is for preventing the drying efficiency from becoming poor due to the foreign matter remained in the filter unit 53 during the drying step S300 is in progress.

In the brush driving step S340, the brush 57 separates the foreign matter from the filter unit 53, and the compression unit 55 compresses and holds the foreign matter separated from the filter unit 53 by the brush 57 in the housing 51.

The brush driving step S340 is repeated periodically until the air supply step is finished, for which the control method of the present invention includes a step S360 for determining whether the air supply step is to be ended or not.

The determination S360 whether the air supply step is to be ended or not may be made by determining whether dryness of the laundry measured is higher than a predetermined dryness or not, or whether a time period of air supply to the drum is reached to a predetermined reference time period or not.

In the step S360 for determining whether the air supply step is to be ended or not, if it is determined that the laundry is dried to a desired level or the time period of air supply to the drum is reached to the predetermined reference time period, the control method of the present invention discontinues 5380 the air supply step, and, thereafter, progresses a cooling step S390. However, if it is determined that the drying object is not dried to the desired level, the control method of the present invention repeats the air supply step S310 and the brush drive step S340.

The cooling step S390 is a step in which only the fan 35 is operated in a state operation of the heater (Heating means) 33 is discontinued. This step is provided for preventing an accident that is liable to take place when the user takes out heated laundry from the drum 2 in advance.

The cooling step 390 is finished by discontinuing operation of the fan after operating the fan 35 for a predetermined time period, and by the finish of the cooling step, the drying step S300 is finished.

Upon finishing the drying step S300, the control method of the present invention progresses the final drive step S500.

The final drive step S500 has an effect of requiring no additional cleaning of the filter unit 53 later when the laundry treating apparatus is used by inducing the user to clean the filter assembly depending on the amount of the foreign matter loaded on the filter assembly before the operation of the laundry treating apparatus is finished.

The final drive step S500 includes a brush final drive step S510 for operating the brush drive unit 6 for a predetermined time period, and a step S520 for determining the amount of the foreign matter loaded on the filter assembly 5 in the brush final drive step.

In this case, though it is preferable that the brush final drive step S510 is started after the cooling step S390 is finished, if the brush final drive step S510 is started while the cooling step S390 is in progress, it has an effect of shortening an operation time period of the laundry treating apparatus.

The brush final drive step S510 is a step for controlling the brush drive unit 6 to make the brush 57 and the compression unit 51 to reciprocate the inside of the holding space 511 of the housing 51 for a predetermined time period.

With this, the control method of the present invention can remove the foreign matter from the filter unit 53 before finishing operation of the laundry treating apparatus.

In the meantime, the step S520 for determining the amount of the foreign matter loaded on the filter assembly is progressed as the magnetic force sensing means 73, 75 senses a position of the magnetic force forming means 71 while the brush final drive step S510 is in progress.

That is, the step S520 for determining the amount of the foreign matter loaded on the filter assembly is progressed by determining whether both of the magnetic force sensing means respectively positioned at the limiting points L1 and L2 of the reciprocating movement of the brush 57 and the compression unit 55 sense the magnetic force forming means 71 or not.

If both of the two magnetic force sensing means 73 and 75 sense the magnetic force forming means 71, the control method of the present invention determines that the amount of the foreign matter held in the housing 51 is small, to finish the operation of the laundry treating apparatus without a separate notifying step.

However, if any one of the two magnetic force sensing means 73 and 75 fails to sense the magnetic force forming means 71, the control method of the present invention finishes the operation of the laundry treating apparatus after progressing a final notifying step S530 for requesting the user to check the filter assembly with a display unit or a speaker.

Figure 7:
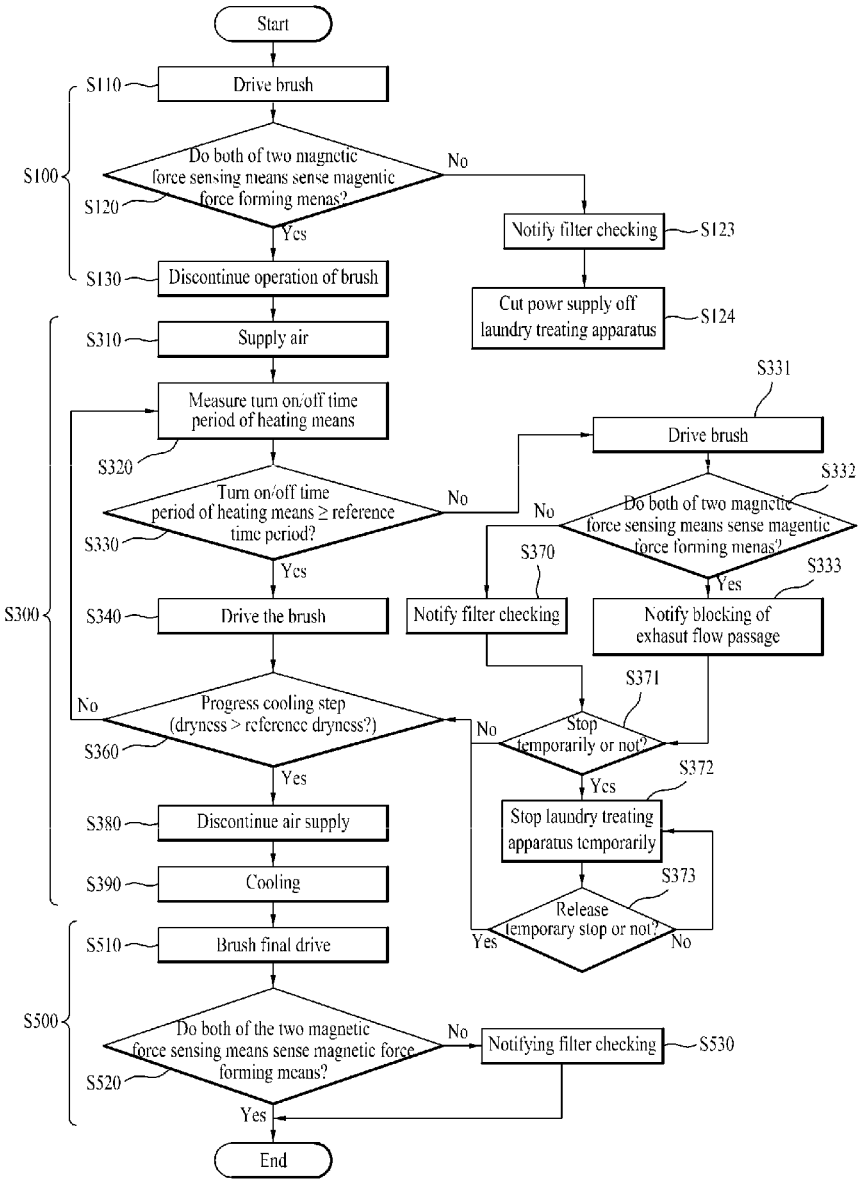
FIGS. 7 and 8 illustrate flow charts each showing the steps of a method for controlling a laundry treating apparatus in accordance with another preferred embodiment of the present invention.

FIG. 7 illustrates another embodiment of the control method of the present invention for enabling to determine whether the filter unit 53 is blocked by the foreign matter or the exhaust flow passage 4 is blocked by the foreign matter.

In general, though the laundry treating apparatus which can dry the laundry shows drop of the drying efficiency due to the foreign matter accumulated at the filter unit 53, the drying efficiency may also drop due to the foreign matter accumulated at the connection duct 41 or the exhaust duct 43 of the exhaust flow passage 4.

Since a case in which the exhaust flow passage 4 is blocked by the foreign matter can not be notified to the user by the control method shown in FIG. 6, an object of the embodiment is to provide a control method which enables to sense blocking of the filter unit 53 (A case when there is a large amount of the foreign matter loaded on the filter assembly) and even blocking of the exhaust flow passage.

The control method in accordance with the embodiment also includes a mount sensing step S100, a drying step S300, and a final drive step S500. Since the mount sensing step and the final drive step S500 are identical to the steps shown in FIG. 6, the embodiment will be described focused on the drying step S300.

The drying step S300 provided to the embodiment also starts with starting an air supply step S310. The air supply step S310 of the embodiment is progressed by operating a heater (Heating means) 33 and a fan 35.

The control method of the embodiment measures S320 an operation period of the heating means 33 during the air supply step S310 is in progress.

If power being supplied to the heating means 33 is controlled by a bimetal, the measurement S320 of the operation period of the heating means may be progressed by measuring a time period required for supplying the power to the heating means from an (n)th time to an (n+1) th time, or by measuring a time period required for re-supplying the power after the power supply to the heating means is cut off with the controller (Not shown).

Figure 8:
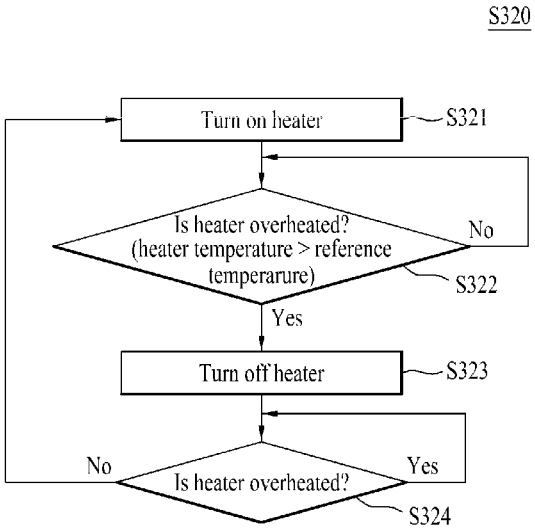

In the meantime, the measurement S320 of the operation time period of the heating means may also be progressed in a mode shown in FIG. 8.

That is, the controller (Not shown) compares a temperature of the heating means 33 to a reference temperature to determine whether the heating means is overheated or not, to measure the operation time period of the heating means while the power is supplied to, or cuts off the power supply to, the heating means 33 depending on overheating of the heating means.

In more detail, if it is determined that the heating means is overheated S322 after power is supplied S321 to the heating means 33, the controller cuts off S323 the power supply to the heating means, and, if it is determined that the overheating is resolved S324 after the power supply to the heating means 33 cuts off, the controller re-supplies S321 the power to the heating means 33.

In this case, the heating means operation period measuring step S320 may be progressed by measuring a time period required for the heating means to have power re-supplied S321 thereto after the controller cuts off the power S323 (Power source turn off), or may also be progressed by measuring a time period required from a time when the power is supplied to the heating means in (n)th time S321 to a time when the power is supplied to the heating means in (n+1)th time S323.

In the meantime, referring to FIG. 7, once the operation time period of the heating means is measured, the control method of the present invention compares the operation time period measured thus to a predetermined reference time period (S330).

If the operation time period of the heating means measured thus is longer than the reference time period, the control method of the present invention progresses a brush drive step S340 for cleaning the filter unit 53 by making the brush 57 and the compression unit 55 to reciprocate the inside of the housing 51.

The brush drive step S340 is run until the laundry is dried to a desired level in a step S360 for determining whether the air supply step is to be finished or not, periodically.

However, if the operation time period of the heating means measured thus is shorter than the reference time period, the control method of the present invention progresses a blocking classifying step S331, S332, S333, S370 for determining whether the filter unit 53 is blocked by the foreign matter, or the exhaust flow passage 4 is blocked by the foreign matter.

The blocking classifying step includes a step S331 for driving the brush 57 and the compression unit 55 for a predetermined time period by controlling the brush drive unit 6, and a step S332 for determining whether both of the two magnetic force sensing means 73 and 75 respectively positioned at the limiting points L1 and L2 of the reciprocating movement of the brush sense the magnetic force forming means 71 during the brush 57 is driven.

If both of the two magnetic force sensing means 73 and 75 sense the position of the magnetic force forming means 71, the control method of the present invention notifies S333 (An exhaust flow passage blocking notifying step) the user of the blocking of the exhaust flow passage 4 of the duct with a display unit or a speaker, and, thereafter, carries out a step S360 for determining whether the air supply step is to be finished or not.

However, if both of the two magnetic force sensing means 73 and 75 fail to sense the magnetic force forming means 71, or if the second magnetic force sensing means 75 fails to sense the magnetic force forming means 71, the control method of the present invention progresses a step S370 for notifying the user of a state the inside of the filter assembly 5 has a full-load of the foreign matter (A step for requesting to remove the foreign matter from the inside of the filter assembly) with the display unit or the speaker provided to the laundry treating apparatus, and, thereafter, carries out the step S360 for determining whether the air supply step is to be finished or not.

In order to prevent problems (Out of order of the laundry treating apparatus, or damage to the clothes) caused by overheating of the heating means 33 from taking place, if the heating means 33 is at a temperature high than a reference temperature, in the laundry treating apparatus, the controller discontinues operation of the heating means to make the temperature of the heating means 33 to be below the reference temperature.

In the meantime, if the filter assembly 5 is loaded with a large amount of the foreign matter, or if the filter unit 53 is blocked with the foreign matter, an air flow rate exhausting from the drum is reduced. And, in a case the exhaust flow passage 4 is blocked with the foreign matter, the air flow rate exhausting from the drum is also reduced.

If the air flow rate exhausting from the drum is reduced by any reason, since the heating means 33 is overheated easily, the operation time period of the heating means 33 tends to become short.

Therefore, upon measuring the operation time period of the heating means 33 and the amount of the foreign matter loaded on the filter assembly, it is possible to determine whether the exhaust flow passage 4 is blocked by the foreign matter or the filter unit is blocked by the foreign matter.

That is, even though the operation time period of the heating means 33 is shorter than the reference time period, the filter assembly 5 has no full-load of the foreign matter (Cases when both of the two magnetic force sensing means sense the magnetic force forming means, or the second magnetic force sensing means 75 senses the magnetic force forming means 71), it may be assumed that the exhaust flow passage 4 is blocked. It is highly possible that this is because the easy heating of the heating means 33 is caused by the blocking of the exhaust flow passage 4 even if the filter assembly 5 has no full-load of the foreign matter.

In the meantime, if the filter assembly 5 has a full-load of the foreign matter (The case the second magnetic force sensing means 75 can not sense the magnetic force forming means 71, and the case at least one of the two magnetic force sensing means can not sense the magnetic force forming means) though the operation time period of the heater 33 is shorter than the reference time period, it is highly possible that the large amount of the foreign matter loaded on the filter assembly 5 causes the short operation time period of the heater 33.

The blocking classifying step S331, S332, S333, S370 described before utilizes such a characteristic of the laundry treating apparatus.

If the connection duct 41 or the exhaust duct 43 is blocked, and if it is determined that the filter assembly 5 has a full-load of the foreign matter, the embodiment does not cut off power supply to the laundry treating apparatus. This is for preventing the user from losing the money the user paid already in a case the laundry treating apparatus of the present invention is used as the commercial laundry treating apparatus.

However, the control method of the present invention may further include a step S371, S372, S373 for requesting user's confirmation on whether the operation of the laundry treating apparatus is to be discontinued or not temporarily after the notification on the blocking of the exhaust flow passage 4 or the blocking of the filter unit is progressed S333, S370.

In the meantime, the reason why the step S360 for determining whether the air supply step is to be finished or not is progressed without progressing the brush drive step S340 for cleaning the filter unit 53 after the blocking classifying step S331, S332, S333, S370 is progressed is because, if the exhaust flow passage 4 is blocked, the problem of the drying efficiency drop can not be solved even if the filter unit 53 is cleaned periodically, and, since the filter assembly 5 has the full-load of the foreign matter already, the problem of the drying efficiency drop can not be solved even if the filter unit 53 is cleaned with the brush 57.

As described before, the step S360 for determining whether the air supply step is to be finished or not can be determined by determining whether the dryness of the laundry is reached to reference dryness, or not, or by determining whether a time period of air supply to the drum is reached to a reference time period or not.

If it is determined that the drying object is dried to a desired level in the step S360 for determining whether the air supply step is to be finished or not, though the control method of the present invention progresses a cooling step S390 after finishing 5380 the air supply step, if it is determined that the drying object is not dried to the desired level, the control method of the present invention repeats the steps described before.

As described before, the cooling step S300 is finished by discontinuing the operation of the fan 35, thereby finishing the drying step S300 of the present invention.

Upon finishing the drying step S300, the control method of the present invention progresses a final drive step S500 (A filter cleaning step after the drying), of which details are identical to the embodiment described with reference to FIG. 6, description of which will be omitted.

Figure 9:
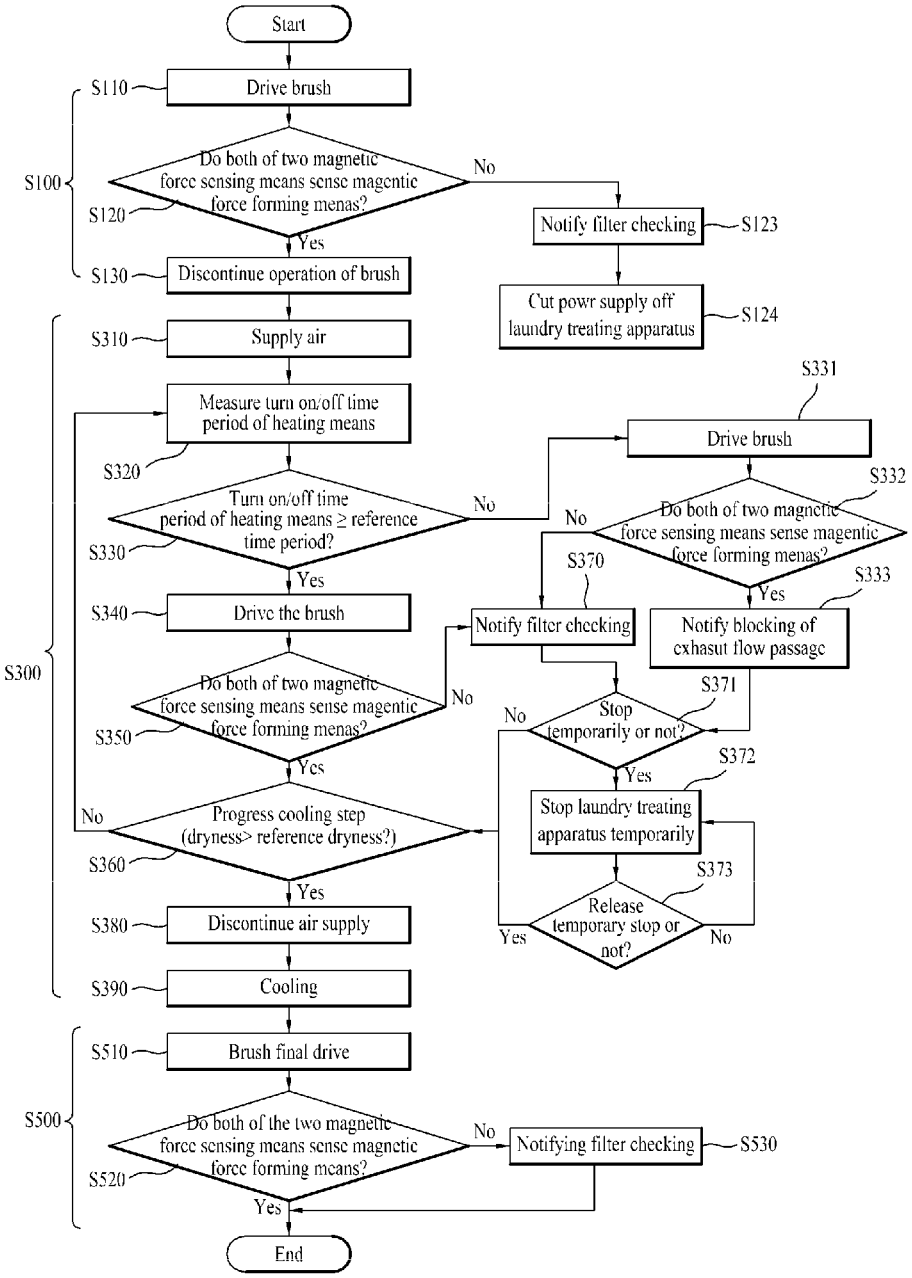
FIG. 9 illustrates a flow chart showing the steps of a method for controlling a laundry treating apparatus in accordance with another preferred embodiment of the present invention.

FIG. 9 illustrates a flow chart showing the steps of a method for controlling a laundry treating apparatus in accordance with another preferred embodiment of the present invention, including a mount sensing step S100, a drying step S300, and a final drive step S500, too.

The control method of the embodiment is identical to the embodiment described with reference to FIG. 7 except a step S350 is further included, for determining an amount of the foreign matter loaded on the filter assembly 5 during the air supply step S310 is in progress.

That is, the control method of the embodiment progresses both a brush drive step S340 for cleaning the filter unit 53 and a step (A loaded amount sensing step) S350 for determining whether both of the two magnetic force sensing means 73 and 75 sense the magnetic force forming means 71 or not during the air supply step S310 is in progress.

If both of the two magnetic force sensing means 73 and 75 sense the magnetic force forming means 71 in the loaded amount sensing step S350, the control method of the present invention performs a step S360 for determining whether the air supply step is to be finished or not.

However, if both of the two magnetic force sensing means 73 and 75 fail to sense the magnetic force forming means 71, or the second magnetic force sensing means 75 fails to sense the magnetic force forming means 71, the control method of the embodiment performs a step (A filter check notifying step) 5370 for requesting the user to remove the foreign matter from an inside of the filter assembly 5 with a display unit (Not shown) or a speaker (Not shown).

The reason why the power supply to the laundry treating apparatus is not cut off even if the filter assembly 5 is loaded with a large amount of the foreign matter in the loaded amount sensing step S350 is for preventing an amount of money the user paid from losing if the laundry treating apparatus of the present invention is used as a commercial laundry treating apparatus (Because the drying step S300 is started already).

However, the control method of the embodiment may also further include a step S371, S372, S373 for requesting user's confirmation on whether the operation of the laundry treating apparatus is to be discontinued or not temporarily after the notification S333, S370 on the blocking of the exhaust flow passage 4 or the blocking of the filter unit is progressed.

Accordingly, if the user is requested S370 to remove the foreign matter from the filter assembly 5, or notified S333 of blocking of the exhaust flow passage 4, the user may select whether to discontinue the operation of the laundry treating apparatus temporarily and to solve a cause of drop of the drying efficiency, or not.

Though the control method described thus has been described with reference to a case in which the first magnetic force sensing means 73 is provided to sense a position of the brush 57, and the second magnetic force sensing means 75 is provided to sense the largest loaded amount of the foreign matter on the housing 51, it is not required to confine the present invention to this.

That is, the control method described before is applicable as far as the brush 57 and the compression unit 55 are provided to reciprocate a predetermined section of the housing 51, and the first magnetic force sensing means 73 and the second magnetic force sensing means 75 are provided to sense whether the brush 57 and the compression unit 55 are reaching to the predetermined two limiting points (both ends of the section) of reciprocating movement or not.

As had been described, the method for controlling a laundry treating apparatus of the present invention has the following advantages.

The present invention an effect of providing a laundry treating apparatus which enables enlargement of a filtering capacity of a filter; and a method for controlling the same.

The present invention an effect of providing a laundry treating apparatus which enables to provide a structure which can, not only increase a flow rate of heated air to be supplied to a drum which holds laundry, but also enlarge filtering capacity, thereby making the laundry treating apparatus to be useful as a commercial dryer; and a method for controlling the same.

The present invention an effect of providing a laundry treating apparatus which enables periodic cleaning of foreign matter accumulated on a filter; and a method for controlling the same.

The present invention an effect of providing a laundry treating apparatus which enables to prevent drying efficiency from dropping during a drying step is in progress by periodic cleaning of a filter by supplying air during the drying step is in progress; and a method for controlling the same.

The present invention an effect of providing a laundry treating apparatus which enables to determine whether a filter is mounted to the laundry treating apparatus or not; and a method for controlling the same.

The present invention an effect of providing a laundry treating apparatus which notifies a user of a filter cleaning time according to an amount of foreign matter remained at a filter; and a method for controlling the same.

The present invention an effect of providing a laundry treating apparatus which enables to determine whether drop of the dry efficiency is caused by a filter blocked by foreign matter or a duct blocked by foreign matter; and a method for controlling the same.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for controlling a laundry treating apparatus having a drum configured to hold laundry, a connection duct configured to exhaust air from an inside of the drum, an exhaust duct arranged in parallel to a length direction of the drum and connected to the connection duct, a filter assembly (i) with a filter unit located at the exhaust duct and extending along a longitudinal direction of the exhaust duct, (ii) configured to filter air guided by the exhaust duct, and (iii) a brush configured to remove foreign matter from the filter unit, a brush drive unit including a brush motor fixed to an outside of the exhaust duct and configured to drive the brush in a reciprocating manner over a section of the filter unit, and a position sensing unit including a magnetic element provided to the brush and two magnetic force sensors configured to sense whether the magnetic element is positioned at a limiting point of reciprocating movement of the brush, the method comprising:

supplying power to the laundry treating apparatus;

operating the brush drive unit temporarily;

after operating the brush drive unit temporarily, determining whether the position sensing unit senses a position of the brush or not;

cutting off power supply to the laundry treating apparatus based on a determination that the position sensing unit fails to sense the position of the brush;

putting an air supply unit into operation to supply heated or unheated air to the drum based on both of the two magnetic force sensors sensing the magnetic element, the putting of the air supply unit into operation to supply heated or unheated air to the drum comprising:

supplying heated air to the drum with a fan that supplies air to the drum;

putting a heater into operation below a predetermined temperature; and discontinuing operation of the heater based on the predetermined temperature being exceeded;

determining whether at least one of the filter unit or the connection duct is blocked by foreign matter based on the operation time period of the heater failing to meet the reference time period during operation of the air supply unit;

notifying, with a display unit or a speaker, after controlling the brush drive unit to reciprocate the brush for a predetermined time period, of a blockage of at least one of the connection duct or the exhaust duct based on both of the two magnetic force sensors sensing the magnetic element; and requesting, with a display unit or a speaker, removal of foreign matter from the filter assembly based on at least one of the two magnetic force sensors failing to sense the magnetic element.

2. The method as claimed in claim 1, wherein cutting off power supply to the laundry treating apparatus occurs based on at least one of the two magnetic force sensors failing to sense the magnetic element.

3. The method as claimed in claim 2, further comprising at least one of displaying, with a display unit, a warning message or emitting, with a speaker, a warning signal before cutting off power supply to the laundry treating apparatus based on at least one of the two magnetic force sensors failing to sense the magnetic element.

4. The method as claimed in claim 3, wherein the warning message is a message that requests a user to remove foreign matter from the filter assembly or to check whether the filter assembly is mounted or not, and wherein the warning signal is a sound signal that requests the user to remove foreign matter from the filter assembly or to check whether the filter assembly is mounted or not.

5. The method as claimed in claim 3, wherein displaying the warning message or emitting the warning signal comprises, based on one of the two magnetic force sensors failing to sense the magnetic element, requesting removal of foreign matter from an inside of the filter assembly with the display unit or the speaker.

6. The method as claimed in claim 3, wherein displaying the warning message or emitting the warning signal comprises, based on both of the two magnetic force sensors failing to sense the magnetic force element, requesting evaluation of whether the filter assembly is mounted or not with the display unit or the speaker.

7. The method as claimed in claim 1, further comprising, during operation of the air supply unit, periodically controlling the brush drive unit to drive the brush in a reciprocating manner over the section of the filter unit, thereby removing foreign matter from the filter unit during operation of the air supply unit.

8. The method as claimed in claim 1, further comprising, based on an operation time period of the heater meeting a reference time period during operation of the air supply unit, controlling the brush drive unit to drive the brush in a reciprocating manner over the section of the filter unit, thereby removing foreign matter from the filter unit during operation of the air supply unit.

9. The method as claimed in claim 1, further comprising:

after the air supply unit has finished operation, controlling, for a predetermined time period, the brush drive unit to drive the brush in a reciprocating manner over the section of the filter unit, thereby removing foreign matter from the filter unit;

requesting, with a display unit or a speaker, removal of foreign matter from the filter assembly based on at least one of the two magnetic force sensors failing to sense the magnetic force element during control of the brush drive unit for the predetermined time period; and finishing operation of the laundry treating apparatus.

10. The method as claimed in claim 1, further comprising putting the fan into operation in a state in which operation of the heater has been discontinued based on dryness of a drying object held in the drum reaching a predetermined dryness level or a progress time period of operation of the air supply unit reaching a predetermined time period.

11. The method as claimed in claim 10, further comprising:

during or after the operation of the fan in the state in which operation of the heater has been discontinued, controlling, for a predetermined time period, the brush drive unit to drive the brush in a reciprocating manner over the section of the filter unit, thereby removing foreign matter from the filter unit during or after the operation of the fan in the state in which operation of the heater has been discontinued;

requesting, with a display unit or a speaker, evaluation of the filter assembly based on at least one of the two magnetic force sensors failing to sense the magnetic element during the brush final drive step is in progress; and finishing operation of the laundry treating apparatus.

12. The method as claimed in claim 1, wherein determining whether the position sensing unit senses a position of the brush or not comprises determining whether the filter assembly is mounted to the duct or not based on the determination of whether the position sensing unit senses the position of the brush or not.

13. A laundry treating apparatus, comprising:

a drum configured to hold laundry;

a connection duct configured to exhaust air from an inside of the drum;

an exhaust duct arranged in parallel to a length direction of the drum and connected to the connection duct;

an air supply unit configured to supply heated or unheated air to the drum;

a filter assembly comprising:

a filter unit located at the exhaust duct, extending along a longitudinal direction of the exhaust duct, and configured to filter air guided by the exhaust duct, and a brush configured to remove foreign matter from the filter unit;

a brush drive unit including a brush motor fixed to an outside of the exhaust duct and configured to drive the brush in a reciprocating manner over a section of the filter unit;

a position sensing unit including a magnetic element provided to the brush and two magnetic force sensors configured to sense whether the magnetic element is positioned at a limiting point of reciprocating movement of the brush; and a control unit configured to:

supply power to the laundry treating apparatus;

operate the brush drive unit temporarily;

after operating the brush drive unit temporarily, determine whether the position sensing unit senses a position of the brush or not;

cut off power supply to the laundry treating apparatus based on a determination that the position sensing unit fails to sense the position of the brush;

put, based on both of the two magnetic force sensors sensing the magnetic element, an air supply unit into operation to supply heated or unheated air to the drum with a fan that supplies air to the drum, put a heater into operation below a predetermined temperature, and discontinue operation of the heater based on the predetermined temperature being exceeded;

determine whether at least one of the filter unit or the connection duct is blocked by foreign matter based on the operation time period of the heater failing to meet the reference time period during operation of the air supply unit;

notify, with a display unit or a speaker, after controlling the brush drive unit to reciprocate the brush for a predetermined time period, of a blockage of at least one of the connection duct or the exhaust duct based on both of the two magnetic force sensors sensing the magnetic element; and request, with a display unit or a speaker, removal of foreign matter from the filter assembly based on at least one of the two magnetic force sensors failing to sense the magnetic element.

14. The laundry treating apparatus as claimed in claim 13, wherein the control unit is configured to cut off power supply to the laundry treating apparatus based on at least one of the two magnetic force sensors failing to sense the magnetic element.

15. The laundry treating apparatus as claimed in claim 14, wherein the control unit is configured to, during operation of the air supply unit, periodically control the brush drive unit to drive the brush in a reciprocating manner over the section of the filter unit, thereby removing foreign matter from the filter unit during operation of the air supply unit.

16. The laundry treating apparatus as claimed in claim 13, wherein the length direction of the drum is parallel to an axis of rotation of the drum.

* * * * *